United States Patent [19]

Johansson et al.

[11] 4,209,978

[45] Jul. 1, 1980

[54] METHOD OF BENDING A LINK BLANK INTO A CHAIN LINK AND A BENDING MACHINE FOR CARRYING OUT THE METHOD

[75] Inventors: Sigge Johansson; Rolf Bergström, both of Ramnäs, Sweden

[73] Assignee: Bulten-Kanthal AB, Hallstahammar, Sweden

[21] Appl. No.: 914,820

[22] Filed: Jun. 12, 1978

[30] Foreign Application Priority Data

Jun. 17, 1977 [SE] Sweden ..... 7707080

[51] Int. Cl.[2] ..... B21L 1/02

[52] U.S. Cl. ..... 59/27; 59/35 R

[58] Field of Search ..... 59/16, 18, 22, 23, 24, 59/25, 27, 35, 10, 12

[56] References Cited

U.S. PATENT DOCUMENTS

| | | | |
|---|---|---|---|
| 976,568 | 11/1910 | Hoff | 59/24 |
| 3,580,030 | 5/1971 | Bean | 59/27 |
| 3,759,034 | 9/1973 | Trofimov | 59/27 |

*Primary Examiner*—Charlie T. Moon

*Assistant Examiner*—Gene P. Crosby

*Attorney, Agent, or Firm*—Pollock, Vande Sande & Priddy

[57] ABSTRACT

A method and a device for bending a rod-shaped link blank into a substantially closed chain link, particularly while at the same time hooking the link blank into a chain end. According to the invention, the blank is brought into a first receiving position with one of its end portions located between, on the one hand, two rotatable abutment rollers disposed at a distance from each other and, on the other hand, a bending tool movable back and forth transversely between said abutment rollers. The bending tool is then brought to a position between the two rollers so as to bend said one end portion of the link blank. The link blank is then brought out from the abutment rollers and is placed in a second receiving portion with its other end portion located between, on the one hand, the abutment rollers and, on the other hand, the bending tool, and the bending tool is then again moved in between the rollers so as to bend said other end portion of the link blank, possibly while at the same time hooking said one bent end portion of the link blank into the last link of a chain end.

23 Claims, 11 Drawing Figures

METHOD OF BENDING A LINK BLANK INTO A CHAIN LINK AND A BENDING MACHINE FOR CARRYING OUT THE METHOD

BACKGROUND OF THE INVENTION

The invention relates to a method and apparatus for bending a rod-shaped link blank into an essentially closed chain link, in particular while at the same time hooking the link blank into a chain end. The method and the apparatus according to the invention are useful in the manufacture of chains, particularly of large dimensions, and may therefore form the first station in a plant, in which the link blank, upon being bent and hooked into a previously finished link, is welded and possibly provided with a central link stud.

SUMMARY OF THE INVENTION

The purpose of the invention is to provide an automatic, reliable and precise bending and hooking operation of the link blank. This purpose is achieved by a method and a bending machine according to the invention, the method being characterized in that the blank is brought into a first receiving position with one of its end portions located between, on the one hand, two rotatable abutment rollers disposed at a distance from each other and, on the other hand, a bending tool being movable back and forth transversely between said abutment rollers, that the bending tool is brought in between the two rollers so as to bend said one end portion of the link blank, that the link blank is brought out from the abutment rollers and is placed in a second receiving portion with its other end portion located between, on the one hand, the abutment rollers and, on the other hand, the bending tool, and that the bending tool is again brought in between the rollers so as to bend said other end portion of the link blank.

The invention will be explained in detail with reference to the accompanying drawings illustrating a non-limiting embodiment.

DESCRIPTION OF AN EXEMPLARY EMBODIMENT

Figure 1:
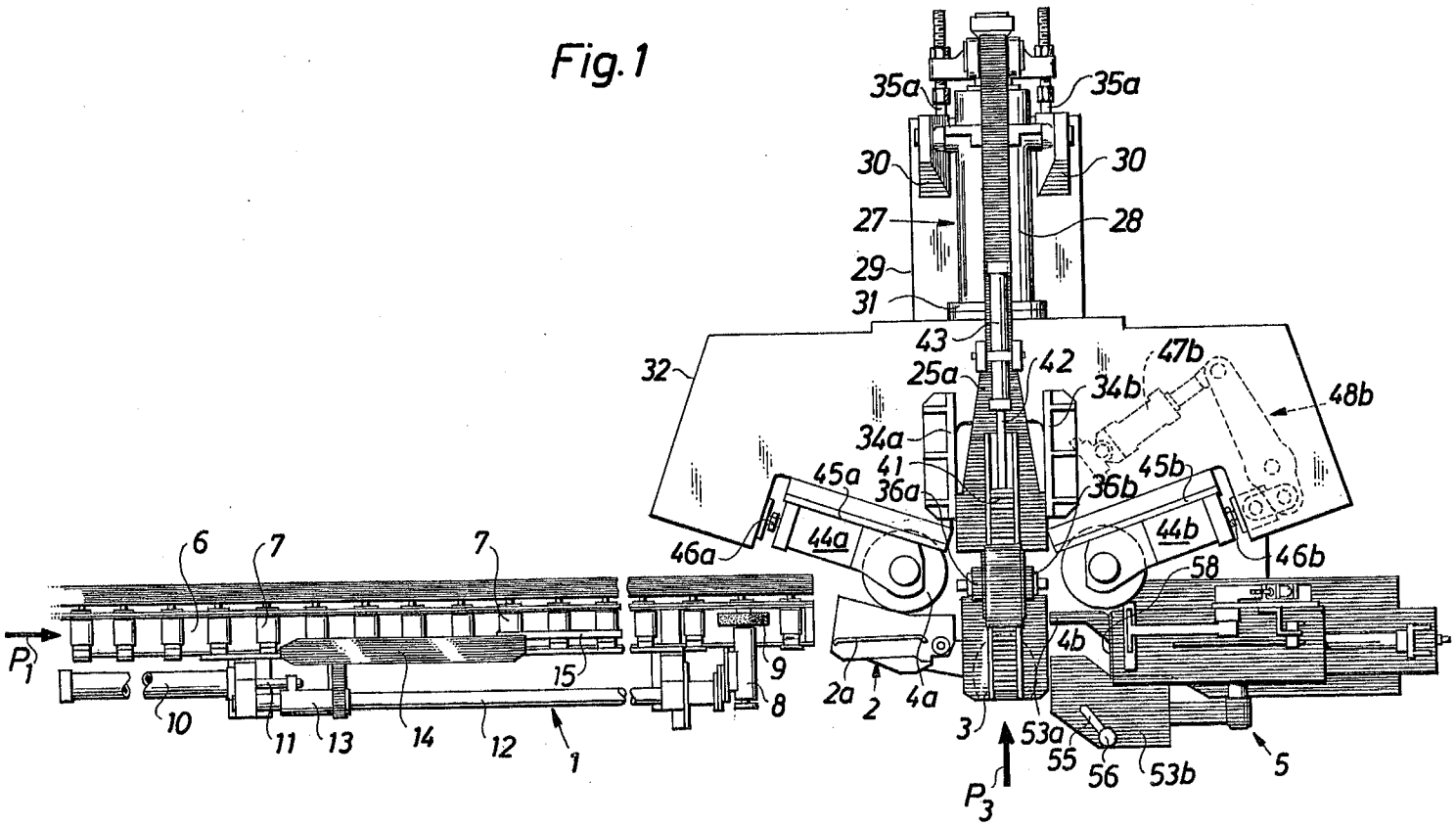
FIG. 1 is a schematical horizontal view of a bending machine according to the invention.

The bending machine shown in FIG. 1 comprises basically a feeding device 1, a handling table 2 adjacent thereto, a bending tool 3, which is movable along a movement path between two abutment rollers 4*a*, 4*b*, and a receiving and support table 5.

Feeding Device

The feeding device 1 (to the left in FIG. 1) consists essentially of a straight roller way 6 having a series of driven rollers 7 for feeding one link blank after the other from a furnace (not shown), in which the blanks are heated to facilitate the succeeding bending operation. Thus, each rod-shaped link blank is fed horizontally in the direction of the arrow $P_1$ and is transferred to the handling table 2 between an upright guide plate 2*a* and the forward abutment roller 4*a*. At the end of the roller way 6, a brush apparatus 8 provided with a rotating brush disc 9 may be arranged to brush the link blank immediately before the bending operation.

Figure 8:
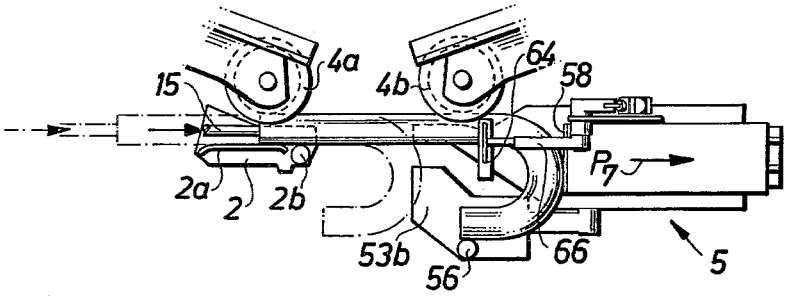
Figure 9:
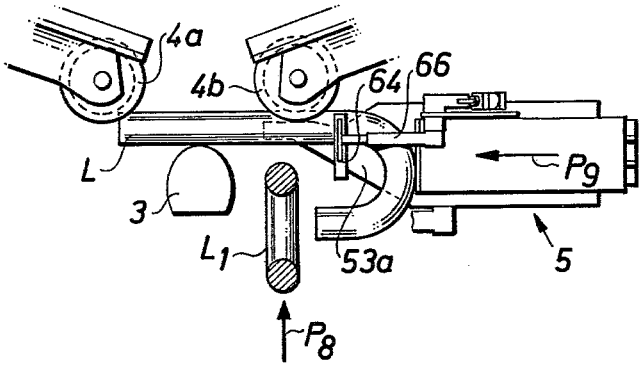

For pushing the link blank into a first stand-by or receiving position (FIG. 5) between on the one hand the counter rollers 4*a*, 4*b* and on the other hand the bending tool 3, an inserting device is located adjacent the roller way 6, said device comprising a long pneumatic cylinder 10, the piston rod 11 of which is connected to a sleeve 13, which is movable along a guide rod 12. An elongated side-guiding plate 14 is vertically adjustably mounted on the sleeve 12, and on the front end of the side-guiding plate 14 an inserting rod 15 is mounted which, in its lowered position, will push on the rear end of the link blank (compare FIGS. 5 and 8), when the piston rod 11 of the cylinder is actuated towards the right in FIG. 1.

Handling Table

Figure 4:
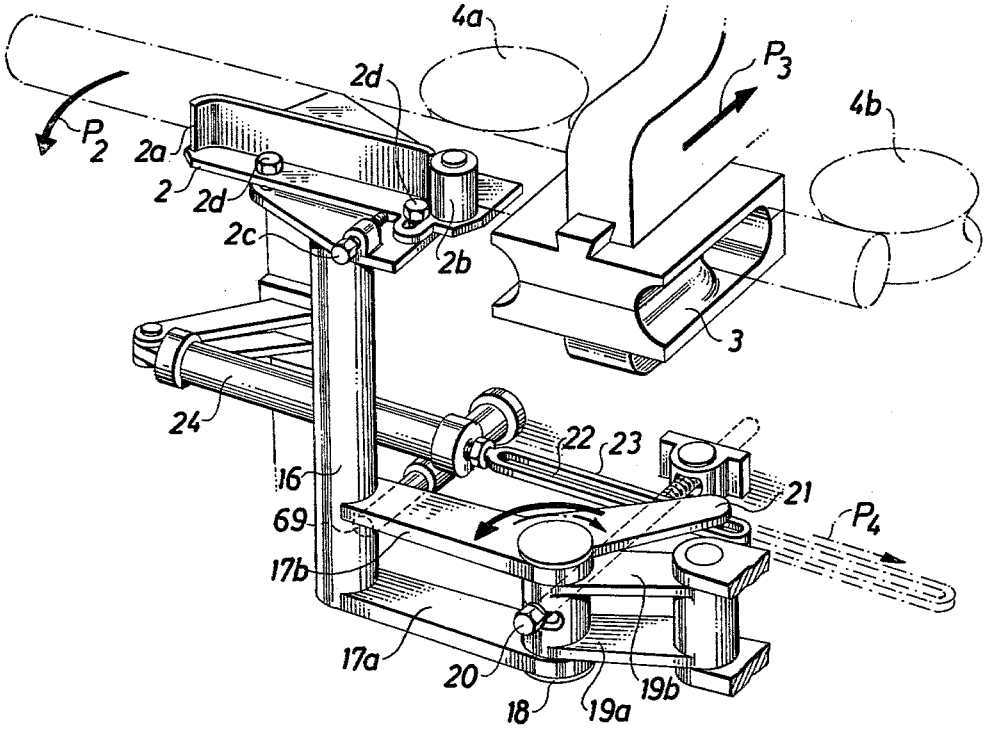
FIG. 4 is a perspective view, likewise in a larger scale, of a pivotable handling table (shown at the bottom in FIG. 1) and the above mentioned bending tool.

The mounting of the handling table 2 is shown in detail in FIG. 4. The horizontal table 2, including its upright guide plate 2*a* and, adjacent thereto, a guide roller 2*b*, which is rotatable around a vertical axis, is adjustably (by means of an adjusting screw 2*c* and locking screws 2*d*) arranged on a vertical pillar 16, which by means of link arms 17*a*, 17*b* is movable along a circular curve around a pivot axis 18, which in turn is adjustably mounted at the machine support by means of link arms 19*a*, 19*b* and an adjusting screw 20. Thus, the table 2 can be swung along a circular curve in its horizontal plane. From the illustrated position, the table 2 can swing freely in the direction of the arrow $P_2$ (during the bending operation while the bending tool 3 is actuated in the direction of the arrow $P_3$ between the abutment rollers 4*a*, 4*b*), a further link arm 21, connected to the link arm 17*b*, and having a guide pin, being moved along a longitudinal slot 22 of an actuating rod 23, which is secured to the piston rod of a pivotably mounted cylinder 24. Thus, the swinging motion in the direction of the arrow $P_2$ may continue until the guide pin of the link arm 21 has reached the opposite end of the slot 22 and the piston rod has taken its fully retracted position as shown (compare FIGS. 6 and 7). When the handling table 2 is to be returned to the position shown in FIGS. 4 and 5, the cylinder 24 is actuated, whereby the actuating rod 23 is protruded in the direction of the arrow $P_4$ and the link arms 21, 17*a*, 17*b* are pivoted clockwise around the pivot axis 18, until the pillar 16 hits a stop means 69.

Bending Tool and Abutment Rollers

Figure 2:
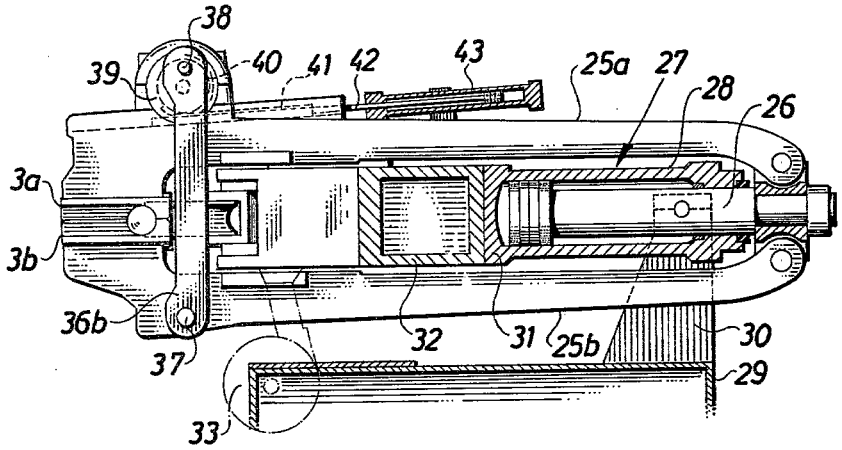
FIG. 2 is a side view, partly in vertical section, of the bending tool of the machine and the actuating device thereof.

As shown in FIG. 2 the bending tool 3 comprises two complementary tool halves 3*a*, 3*b*, which are secured to an upper and a lower member of a pair of tongs 25*a*, 25*b* and, in their closed position, have a surface which, in principle, is partly complementary to an inner half part of a chain link and is partly an opposite, semi-cylindrical surface (compare also FIG. 4), enabling the link blank to be held in a tong-like grip between the tool-halves 3*a*, 3*b*. The tong members 25*a*, 25*b* are at their rear (to the right in FIG. 2) ends pivotably mounted to the piston rod 26 of a hydraulic cylinder 27, the cylinder tube 28 of which is pivotably mounted at two brackets 30 secured to the machine support 29 (compare also FIG. 1). The front end 31 of the cylinder 27 is secured to a machine frame 32, which is vertically adjustable by means of a height adjuster 33. The front end portions of the tong members 25*a*, 25*b* are guided sideways relative to the machine frame 32, as appears from FIG. 1, which shows the upper tong member 25*a* being guided between two guide rails 34*a*, 34*b*. Thus, by means of the hydraulic cylinder 27, the tong members 25*a*, 25*b* and the tool-halves 3*a*,3*b* attached thereto can be moved to and fro in the direction of the arrow $P_3$ (FIGS. 1 and 4) while being guided also at their rear ends by the guides 35*a*, 35*b*.

The front end portions of the tong members 25*a*, 25*b* are coupled to each other by means of two side-links 36*a*,36*b*, each being pivotably mounted at its lower end on a pin 37 on the lower tong member and, at its upper end, journalled to a eccentrically located pin 38 on a rotatable wheel 39 having a tooth segment 40 and mounted on the upper tong member. Said tooth segment 40 meshes with the teeth of a rack 41 connected to the piston rod 42 of a cylinder 43. By actuating the cylinder 43, the tong members 25*a*, 25*b* can be pivoted vertically towards and away from each other about their rear ends, whereby the tool halves 3*a*,3*b* can be closed around the link blank (the position shown in FIG. 2) and opened again to release the link blank.

As further seen in FIGS. 1,2 and 4, two profiled abutment rollers 4*a*, 4*b* are mounted for free rotation around vertical studs on each side of the horizontal movement path (arrow $P_3$) of the bending tool. Each abutment roller 4*a*,4*b* is mounted on a fork-shaped bracket 44*a*,44*b* which is movable along a guide member 45*a*, 45*b* in a direction at an angle of about 20° (19.5° in the illustrated example) to an outer extension of an imaginary line connecting the axes of the abutment rollers. Hereby, by means of adjusters 46*a*, 46*b*, it is possible to displace the abutment rollers 4*a*,4*b* into a position suitable to the dimensions of a particular link blank (the guide means 2*a*,2*b* are also adjustable with respect thereto). As shown to the right in FIG. 1, the abutment rollers 4*a*,4*b* are displaced along the guide members 45*a*, 45*b*, respectively, by means of a lever arm mechanism 48*a*, 48*b*. This displacement of the abutment rollers is used in the final stage of the respective bending operations, as will be explained further below.

Support and Receiving Table

Figure 3:
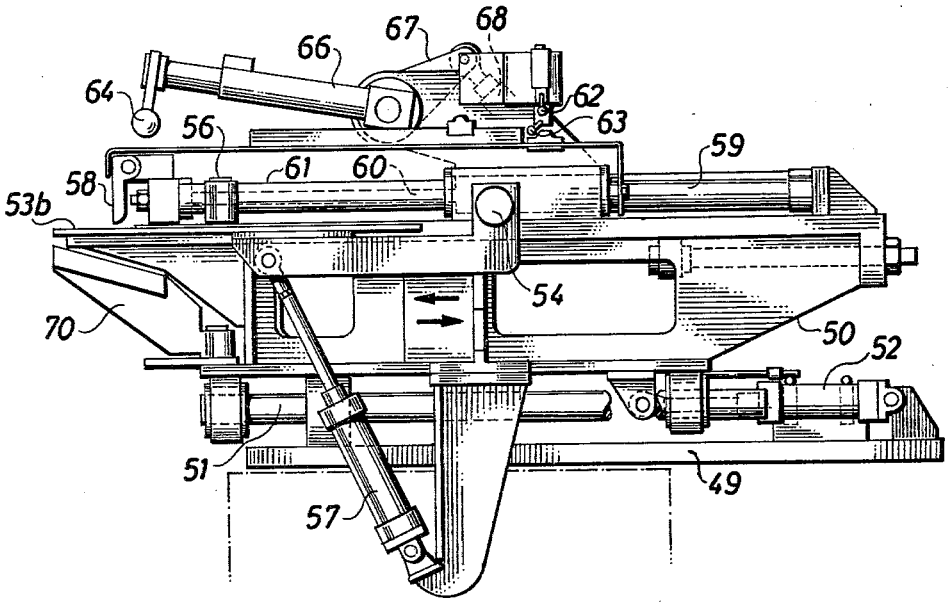
FIG. 3 is a side view, in a larger scale, of a support and receiving table, which is shown at the bottom to the right in FIG. 1 and is movable back and forth.

The support and receiving table 5 is shown at the bottom to the right in FIG. 1 as well as in FIG. 3. A frame 50 is movable to and fro (in parallel to the feed direction $P_1$) on a support by means of guide members 51 and a cylinder 52. On the frame 50, a two-piece support table 53*a*, 53*b* is arranged, namely in the form of a narrow support table portion 53*a* (the upper one in FIG. 1) and a wider support table portion 53*b* which can be swung downwardly about an axis 54 and is provided with a guide roller 56 adjustable in a slot 55. By means of a cylinder 57 coupled to the frame 50, pivoting of the support table portion 53*b* can be effected. At the top of the frame 50, a stop means 58 for the link blank is arranged, said stop means being displacable at the upper surface of the support table 53 by means of a cylinder 59 having a piston rod 60 and guide members 61. Thus, the stop means 58 can be moved at will into a forward (shown in FIGS. 1, 3 and 5) and a rear position (indicated in FIGS. 6–11), these positions being sensed by means of limit switches 62,63.

Above the support table, a holding means 64 is secured to an arm 66, which is pivotable in a vertical plane around an axis 65 and can be actuated by means of a link 67 secured to the opposite end of said axis and a cylinder 68. By pivoting the arm 66 with its holding means 64 downwards, the link blank will be held on the support table 53 when the stop means 58 is adjusted into its rear position (compare FIGS. 8 and 9).

First Bending Operation

When a rod-shaped blank is to be bent into the form of a closed chain link, the blank L is fed via the roller way 6 in the direction of the arrow $P_1$ and inserted by means of the inserting rod 15 into a first stand-by or receiving position (FIGS. 4 and 5), in which the front end of the link blank L abuts the stop means 58 of the receiving table 5, said stop means 58 being held in its front position adjacent the rear abutment roller 4*b*. In this first receiving position, the link blank rests on the handling table 2 and on the support table portion 53*a* between (in the horizontal plane), on the one hand, the guide means 2*a*, 2*b* of the handling table and the bending tool 3 and, on the other hand, the abutment rollers 4*a*, 4*b*. During the first bending operation, the tool halves 3*a*, 3*b* (by means of the cylinder 43, FIG. 2) are closed to grip the front end portion of the link blank and, thereafter, by applying a great force, are forced in the direction of the arrow $P_3$ (by means of the hydraulic cylinder 27, FIG. 2) between the abutment rollers 4*a*,4*b* into the position shown in FIG. 6, so that the front end portion of the link blank is bent around the profiled, substantially semi-oval (in horizontal section) surface of the tool 3, whereas the rear, still straight end portion of the link blank rests on the handling table 2 and causes the latter to swing about 90° around the pivot axis 18 (the arrow $P_2$, FIG. 4). In order to compensate for a certain resilience of the front end portion of the link blank being bent to about 180°, the first bending operation is brought to an end by displacing the abutment rollers 4*a*,4*b* in the direction of the arrow $P_5$ against the center portion and the front end, respectively, of the link blank L by means of the cylinders 47*a*, 47*b* and the lever arm mechanisms 48*a*, 48*b* (FIG. 1). Hereby, the front half of the link blank obtains the desired semi-oval shape and, by means of the tool 3, still closed, is brought back from the space between the abutment rollers 4*a*,4*b* by actuating the hydraulic cylinder 27 (FIG. 2) in such a way that the semi-bent link blank L takes the position shown in FIG. 7, resting partly on the handling table 2, partly on the support table portions 53*a*, 53*b*.

Second Bending Operation

Figure 6:
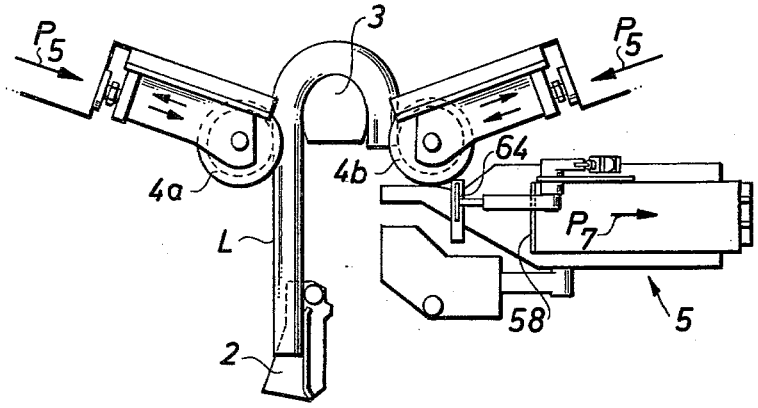
Figure 7:
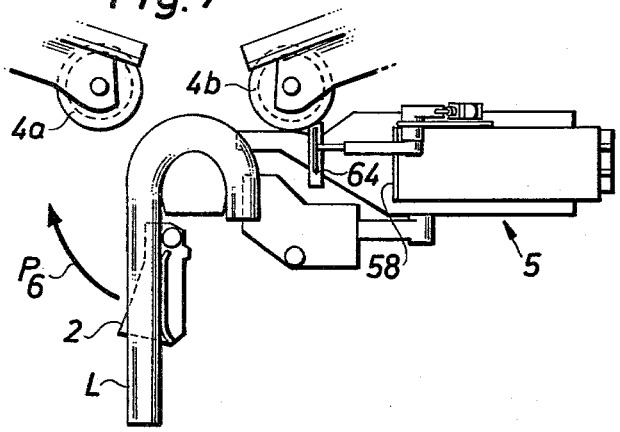

By means of the handling table 2, the link blank L is swung from the position shown in FIG. 7 in the direction of the arrow $P_6$ about 90° by actuating the cylinder 24 (FIG. 4), the tool halves 3*a*, 3*b* having already been separated by means of the cylinder 43 (FIG. 2). The stop means 58 is moved back in the direction $P_7$ (FIG. 6) into its rear position by means of the cylinder 59 (FIG. 3) and, thereafter, the link blank L, by means of the inserting rod 15, is pushed from the position shown in dash-dot lines in FIG. 8 into the position shown in solid lines in the same figure against the stop means 58. In this second stand-by or receiving position, the rear, still straight end portion of the link blank is located between the abutment rollers 4*a*,4*b* on the one hand and the guide means 2a,2b of the handling table 2, the guide roller 56 of the wider support table portion 53b and the tool 3 (not shown in FIG. 8) on the other hand.

Before performing the second bending operation, the link blank is locked onto the narrow support table portion 53a by swinging down the arm 66 with its holding means 64 (FIG. 3), and the whole support and receiving table 5 is moved away some distance in the direction of the arrow $P_7$ by means of the cylinder 52. Also, the support table portion 53b is lowered by means of the cylinder 57 so as to enable the insertion of a previously manufactured end link $L_1$ of a vertically hanging chain end in the direction of the arrow $P_8$ (FIG. 9) against a stop 70 disposed somewhat below the support table portion 53a. Thereafter, the support and receiving table 5 is returned (arrow $P_9$) to the position shown in FIG. 9.

The tool halves 3a,3b are then actuated to enclose the link blank L, and the arm 66 with its holding means 64 is raised. Thereafter, the second bending operation (FIG. 10) is performed by forcing the tool 3 in the direction of the arrow $P_{10}$ in order to bend the rear portion of the link blank into a semi-oval shape while simultaneously hooking the aready (during the first bending operation) bend end portion of the link blank L into the end link $L_1$. Like the first bending operation, the second bending operation is finalized by forcing the abutment rollers 4a,4b in the directions of the arrows $P_{11}$ so as to give the link blank its final, oval shape upon a slight resilient expansion.

Figure 5:
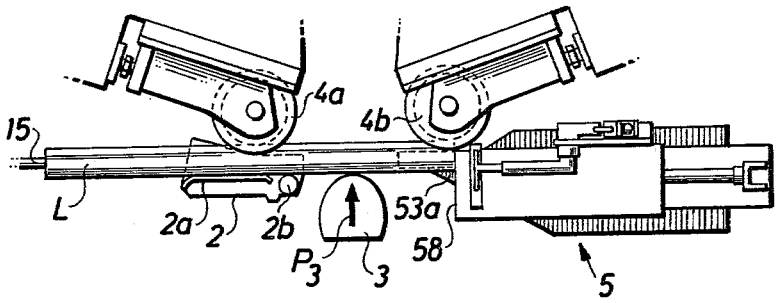
FIG. 5 to 11 illustrate schematically the different steps of bending a link blank in two successive bending operations.

The link blank L is now hooked into the end link $L_1$, and the movable parts of the machine can thus be brought to their respective positions shown in FIG. 5 for receiving and bending the next link blank supplied from the roller way 6.

Figure 10:
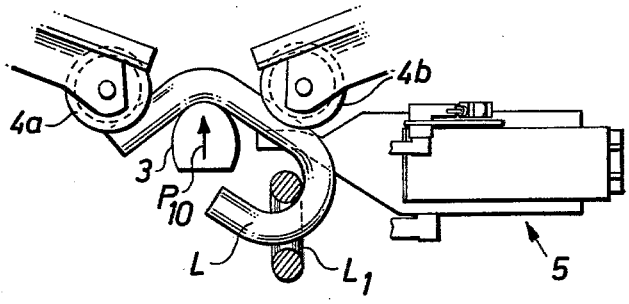

We claim:

1. A method of bending a rod-shaped link blank (L) into a substantially closed chain link, including the steps of (a) bringing said link blank (L) into a first receiving position (FIG. 5) with one of its end portions located between, on the one hand, two rotatable abutment rollers (4a,4b) disposed at a distance from each other and, on the other hand, a bending tool (3) reciprocable transversely between said abutment rollers;

(b) moving said bending tool to a position between said two rollers so as to bend said one end portion of said link blank (FIG. 6); (c) moving said link blank out from the abutment rollers (FIG. 7) and into a second receiving position (FIG. 9) with its other end portion located between, on the one hand, the abutment rollers and, on the other hand, the bending tool; and (d) returning said bending tool to a position between said rollers so as to bend said other end portion of said link blank (FIG. 10, 11).

2. A method as defined in claim 1 wherein said link blank (L) is held by said bending tool (3) during the two bending operations.

Figure 11:
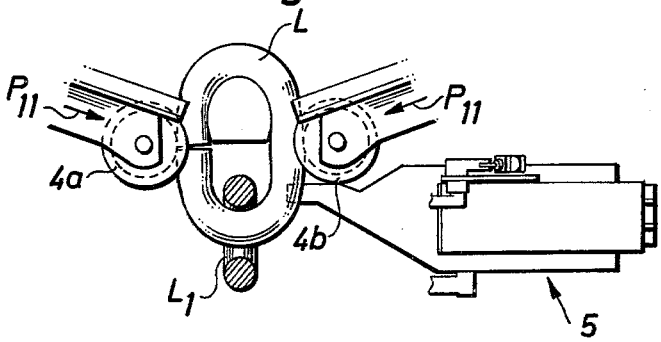

3. A method as defined in claim 1 wherein said abutment rollers (4a,4b), after bringing the bending tool in between and somewhat past said rollers during the respective bending operation, are pressed against said link blank and towards each other so as to compensate for any tendency of said link blank to resiliently expand after being bent substantially 180° (FIGS. 6 and 11).

4. A method as defined in claim 1, wherein during said entire process the link blank (L) is kept oriented in one and the same operating plane including said abutment rollers (4a,4b).

5. A method as defined in claim 4, wherein said link blank (2) is fed longitudinally to said first receiving portion in a first direction ($P_1$) extending in said operating plane, said first direction being parallel to an imaginary line connecting the axes of said abutment rollers (4a,4b), and during said two bending operations the bending tool (3) is moved in a second direction ($P_3$) extending in said operating plane at right angles to said first direction.

6. A method as defined in claim 5, wherein said link blank (L) is fed towards and against a stop means (58) positionable in said first direction ($P_1$).

7. A method as defined in claim 6, wherein said link blank (L) is first fed against said stop means upon positioning the latter into a first stop position (FIG. 5) substantially adjacent to the rear abutment roller (4b), and said link blank upon completion of the first bending operation, retraction from the abutment rollers and turning in said operating plane is again brought, in this case with its bent end portion, against said stop means upon positioning the latter into a second stop position (FIG. 8) beyond said first stop position.

8. A method as defined in claim 7, said link blank (L) prior to the second bending operation (FIG. 8) is moved further away in said first direction ($P_7$), preferably together with said stop means, whereafter the last link ($L_1$) of a chain end is moved substantially adjacent said rear abutment roller (4b) and oriented in a plane substantially at right angles to said first direction, whereafter said link blank is brought back to said second receiving position (FIG. 9) and the second bending operation is carried out while hooking said link blank into said last link.

9. A bending machine for bending a rod-shaped link blank (L) into a substantially closed chain link, comprising support and handling means (2,3,5) for said link blank, said means being disposed in operative connection to a feeding device (1) and being adapted to hold said link blank, prior to a first bending operation, in a first receiving portion (FIG. 5) with one end portion of said link blank located between, on the one hand, two abutment rollers (4a,4b) rotatably mounted at a distance from each other and, on the other hand, a bending tool (3) movable along a path transversely between said abutment rollers, said means being adapted to place said link blank, upon completion of said first bending operation, in a second receiving position (FIG. 9) with the other end portion of said link blank located between, on the one hand, said abutment rollers (4a,4b) and, on the other hand, said bending tool (3), so that said link blank can be completely bent in a second bending operation.

10. A bending machine as defined in claim 9, wherein said feeding device comprises an inserting device (15) for pushing the link blank into said first and second receiving positions towards and against a stop means (58) of said support and handling means (5), said stop means being positionable in the feed direction.

11. A bending machine as defined in claim 9, wherein said bending tool (3) comprises two complementary tool halves (3a,3b) movable towards and away from each other.

12. A bending machine as defined in claim 9, wherein said feeding device (1) comprises a roller way (6) adapted to feed said link blank into said first receiving position in parallel with an imaginary line connecting the axes of said abutment rollers (4*a*,4*b*).

13. A bending machine as defined in claim 12, wherein the rollers (6) of said roller way are driven.

14. A bending machine as defined in claim 9, wherein said support and handling means comprise a handling table (2) for supporting said other end portion of said link blank, said handling table being disposed between said feeding device and the movement path of said bending tool and being turnable at least 90° between a first pivot position (FIG. 5) adjacent one (4*a*) of said abutment rollers and a second pivot position (FIGS. 6,7) adjacent the movement path of said bending tool (3).

15. A bending machine as defined in claim 14, wherein said handling table (2) is adapted to turn freely from said first into said second pivot position during said first bending operation and, thereafter, to turn back to said first pivot position by means of actuating means (24) (FIG. 4).

16. A bending machine as defined in claim 15, said support and handling means comprise a support table (5) for supporting said first end portion of said link blank and located adjacent to the other one (4*b*) of said abutment rollers.

17. A bending machine as defined in claim 16, wherein a stop means (58) is disposed on said support table (5) and wherein said support table is reciprocable in the longitudinal direction of said link blank to said first receiving position.

18. A bending machine as defined in claim 16, wherein a portion (53*b*) of said support table (5) is adapted to be moved away (FIGS. 8,9) to enable hooking the bent end portion of said link blank into the last link ($L_1$) of a chain end.

19. A bending machine as defined in claim 16, wherein a movable holding means (64) is adapted to hold said link blank on said support table (53*a*) prior to said second bending operation.

20. A bending machine as defined in claim 9, wherein said bending tool (3) is profiled into a shape, which is substantially complementary to half of the inside of the finished link.

21. A bending machine as defined in claim 20, wherein said profiled portion of said bending tool extends circumferentially through an angle exceeding 180° and that the rotary axes of said abutment rollers (4*a*,4*b*) are movable in directions ($P_5$,$P_{11}$) towards and away from each other, said abutment rollers being adapted to press against opposite portions of the link blank at the end of the respective bending operations so as to compensate for any tendency of the link blank to resiliently expand after being bent substantially 180° (FIGS. 6,11).

22. A bending machine as defined in claim 9, wherein the positions of said abutment rollers (4*a*,4*b*) are adjustable along a respective displacement line forming an acute angle, e.g. 10° to 45° , to an outer extension of an imaginary line connecting the axes of the abutment rollers.

23. A bending machine as defined in claim 22, wherein said abutment rollers are mounted in a respective holding means (44*a*,44*b*) displacable along said displacement line by means of a lever arm mechanism (48*a*, 48*b*), actuable by means of an actuating cylinder (47*a*, 47*b*).

* * * * *